US008371256B2

(12) United States Patent
Durrett et al.

(10) Patent No.: US 8,371,256 B2
(45) Date of Patent: Feb. 12, 2013

(54) INTERNAL COMBUSTION ENGINE UTILIZING DUAL COMPRESSION AND DUAL EXPANSION PROCESSES

(75) Inventors: Russell P. Durrett, Bloomfield Hills, MI (US); Venkatesh Gopalakrishnan, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 766 days.

(21) Appl. No.: 12/472,463

(22) Filed: May 27, 2009

(65) Prior Publication Data

US 2010/0300385 A1 Dec. 2, 2010

(51) Int. Cl.
*F02B 25/00* (2006.01)

(52) U.S. Cl. ..... 123/70 R; 123/65 R; 123/72; 123/311

(58) Field of Classification Search ..... 123/70 R, 123/311, 65 R, 69 R, 69 V, 72
See application file for complete search history.

(56) References Cited

U.S. PATENT DOCUMENTS

| | | | | |
|---|---|---|---|---|
| 1,176,252 | A | 3/1916 | Schenker | |
| 1,634,468 | A | 7/1927 | Muller | |
| 1,771,335 | A | 9/1927 | Karpes | |
| 1,690,080 | A | 10/1928 | Seng et al. | |
| 2,255,925 | A * | 9/1941 | Heylandt | 60/620 |
| 2,534,590 | A * | 12/1950 | Gerhardt | 123/52.5 |
| 2,621,473 | A * | 12/1952 | Naccache | 60/599 |
| 3,220,392 | A * | 11/1965 | Cummins | 123/321 |
| 3,896,775 | A | 7/1975 | Melby | |
| 4,202,300 | A | 5/1980 | Skay | |
| 4,487,020 | A * | 12/1984 | Dineen | 60/521 |
| 4,565,167 | A * | 1/1986 | Bryant | 123/70 R |
| 4,663,938 | A * | 5/1987 | Colgate | 60/620 |
| 4,917,054 | A | 4/1990 | Schmitz | |
| 5,199,262 | A * | 4/1993 | Bell | 60/622 |
| 5,542,382 | A | 8/1996 | Clarke | |
| 6,286,467 | B1 * | 9/2001 | Ancheta | 123/21 |
| 6,553,977 | B2 | 4/2003 | Schmitz | |
| 6,698,405 | B2 | 3/2004 | Bigi | |
| 7,117,827 | B1 * | 10/2006 | Hinderks | 123/43 R |
| 2006/0011154 | A1 * | 1/2006 | Scuderi et al. | 123/70 R |
| 2007/0017477 | A1 * | 1/2007 | Zajac | 123/190.1 |

FOREIGN PATENT DOCUMENTS

| | | |
|---|---|---|
| DE | 4441590 | 2/1996 |
| DE | 19630520 | 4/1997 |
| EP | 959233 | 11/1999 |
| WO | WO 03058043 | 7/2003 |

* cited by examiner

*Primary Examiner* — Noah Kamen
*Assistant Examiner* — Long T Tran

(57) ABSTRACT

Engines and processes for their operation include a compressor cylinder, at least one power cylinder, and an expander cylinder. The outlet of the compressor cylinder is fed to the inlet of a power cylinder, and the outlet of the power cylinder is fed to the expander cylinder. The compressor cylinder and the expander cylinder are operated in two-stroke fashion, and the power cylinder is operated in four-stroke fashion, all of which cylinders share a common crankshaft. Heat may be recuperated from the exhaust gas and directed to the inlet gas of the power cylinder, increasing overall efficiency.

23 Claims, 4 Drawing Sheets

C2 - Compression 2

E1 - Expansion 1

E2 - Expansion 2

INTERNAL COMBUSTION ENGINE UTILIZING DUAL COMPRESSION AND DUAL EXPANSION PROCESSES

TECHNICAL FIELD

This disclosure is generally related to combustion engines, including internal combustion spark-ignition engines and compression-ignition engines. More particularly, it concerns an internal combustion engine that employs dual processes for compression and expansion of an air-fuel mixture.

BACKGROUND

The statements in this section merely provide background information related to the present disclosure and may not constitute prior art.

Modern combustion engines are generally of the spark-ignition type and the compression-ignition type. During operation, the efficiency of a combustion engine depends on many factors, including volumetric and thermodynamic efficiency. In order to enhance the former, designers have for decades provided engines with forced induction devices including turbo-chargers and super-chargers, which are predominantly mere add-ons to a basic engine design. While relatively easy to service, these devices can be problematic and are limited from several aspects inherent to their design.

SUMMARY

An internal combustion engine includes a compressor cylinder, at least one power cylinder and an expander cylinder. Each cylinder has a respective bore and piston slidably disposed therein, valved inlet port, and valved outlet port. Each respective piston is operatively connected to a crankshaft. The outlet port of the compressor cylinder is provided with a passage through which gas expelled from the compressor cylinder is directed to the inlet port of the at least one power cylinder. The outlet port of the at least one power cylinder is provided with a passage through which gas expelled from the at least one power cylinder is directed to the inlet port of the expander cylinder. The engine further includes a camshaft operatively connected to the crankshaft sufficient to cause the valves present on the inlet ports and the outlet ports of the compressor cylinder and the expander cylinder to each undergo one open-closed cycle for every revolution of the crankshaft, and to cause the valves present on the inlet port and the outlet port of the at least one power cylinder to each undergo one open-closed cycle for every two revolutions of the crankshaft.

BRIEF DESCRIPTION OF THE DRAWINGS

One or more embodiments will now be described, by way of example, with reference to the accompanying drawings, in which.

DETAILED DESCRIPTION

Figure 1:
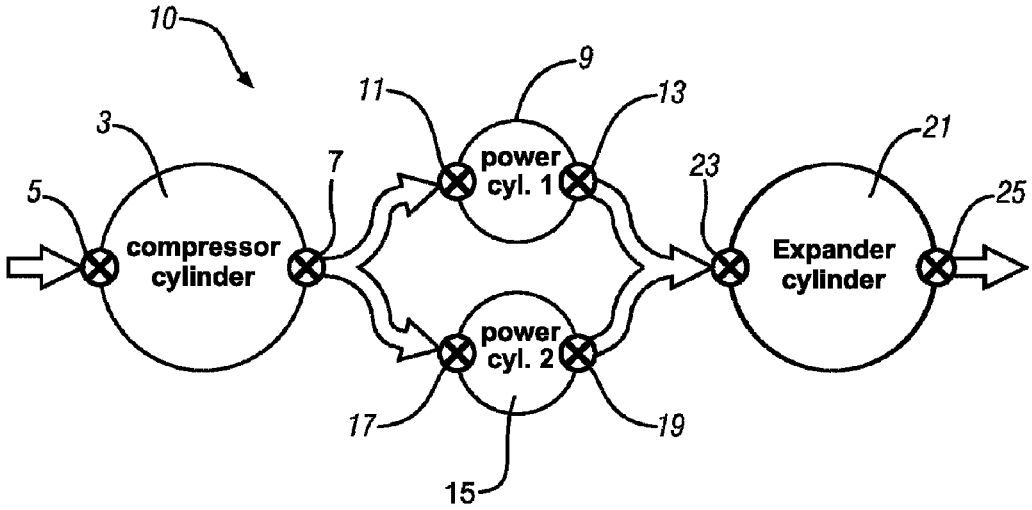
FIG. 1 illustrates a schematic representation of an engine according to one embodiment of the disclosure.

In one embodiment, the present disclosure provides a four-cylinder internal combustion engine comprising a two-stroke compressor cylinder, a two-stroke expander cylinder, and a pair of four-stroke power cylinders. Referring to the drawings, provided only as exemplary illustrations of the disclosure and not for construing same as being delimited thereby, FIG. 1 illustrates a schematic representation of an engine 10 according to one embodiment. In FIG. 1 is shown a compressor cylinder 3 that typically comprises a bore and being in one embodiment fitted with a reciprocating piston operatively connected to a rotatable crankshaft by means of a connecting rod, as such arrangements are known in the art. Compressor cylinder 3 has a compressor inlet 5 at which air, in the case of a fuel-injected engine, or an air-fuel mixture as in the case of a carbureted engine, may be admitted at a first pressure p1 which is typically ambient pressure, but in other embodiments may be any provided pressure above ambient pressure. Compressor cylinder 3 additionally comprises a compressor outlet 7, through which gases present are transferred from the compressor cylinder 3 at a second pressure p2 by virtue of upward motion of the reciprocating piston within the cylinder bore, which second pressure p2 is preferably a higher pressure than first pressure p1. In preferred embodiments, the compressor inlet 5 and compressor outlet 7 are valve-controlled passages, the valves present being actuated by at least one camshaft or other known means in effective operative connection therewith to provide valve timing sufficient to enable second pressure p2 to exceed first pressure p1 in magnitude as a result of an upward stroke of the aforementioned piston. In one embodiment, the valves at the compressor inlet 5 and the compressor outlet 7 are conventional valves of the type used in combustion engines, and the compressor cylinder 3 is operated in two-stroke fashion, with one compression stroke occurring for every rotation of the crankshaft to which the piston is connected.

Upon being forced out of compressor cylinder 3, the compressed gases are directed to the inlet of a power cylinder, which power cylinder comprises a piston that is connected to a crankshaft, which in some embodiments is the same crankshaft as is the piston of the compressor cylinder 3. The power cylinder is equipped with at least one inlet valve and at least one outlet valve, with these valves being actuated to have timing events effective to enable the power cylinder to operate in conventional 4-stroke fashion, i.e., having one power stroke and one exhaust stroke for every two rotations of the crankshaft. In one embodiment, there is a single power cylinder. In another embodiment, such as that shown in FIG. 1 two power cylinders are present, a first power cylinder 9 and a second power cylinder 15, the compressor cylinder 3 being dimensioned sufficiently to enable it to supply intake gas to each of first power cylinder 9 and second power cylinder 15 sufficient to enable it to operate in conventional 4-stroke mode; however, the present disclosure provides for any number of power cylinders between 1 and 4, including 1 and 4, being fed with gas exiting a single compressor cylinder. Thus, the compressor cylinder 3 provides intake gases for the power cylinder(s) at a pressure generally greater than atmospheric and in this regard the compressor cylinder functions analogously to a turbocharger or supercharger. The first power cylinder 9 is equipped with inlet valve 11 and outlet valve 13 and a second power cylinder 15, or additional power cylinders, when present, is also equipped with an inlet valve 17 and an outlet valve 19. The present disclosure also includes embodiments having more than one inlet valve and/or outlet valve per power cylinder. A further feature of an engine 10 according to the disclosure is the presence of an expander cylinder 21, comprising a bore and being in one embodiment fitted with a reciprocating piston operatively connected to a rotatable crankshaft by means of a connecting rod, as such arrangements are known in the art. In one embodiment, the crankshaft to which the piston of the expander cylinder 21 is connected is common to the crankshaft to which the pistons of the compressor cylinder 3 and power cylinder(s) are connected, the throws on the crankshaft being configured to enable operation of an engine provided herein according to the description set forth in reference to FIGS. 2A-2F. The expander cylinder 21 is dimensioned sufficiently to be capable of accommodating exhaust gases of the selected number of power cylinders whose exhaust output gases are directed to the expander cylinder 21 through its inlet valve(s), which in one preferred embodiment is two power cylinders. Provision for travel of gases through inlet and outlet valves as described herein is provided by integral passages cast into manifolds and cylinder heads, and one or more valve-actuating rotatable camshafts or other valve actuating means using techniques generally known in the art. In one embodiment, an existing multi-cylinder piston-operated internal combustion engine is caused to operate as described herein by alteration of existing camshaft profiles to enable one or more existing cylinders to function as a compressor cylinder and one or more existing cylinders to function as an expander cylinder, with appropriate gas flow passages being provided between existing inlet and outlet ports, as described herein. In preferred embodiments, expander cylinder 21 is operated in a two-stroke fashion. Upon exiting the expander cylinder 21, the engine exhaust gases are either vented directly to the atmosphere or are routed to an exhaust gas aftertreatment system comprising a known system for reducing emissions, typically including oxidation and reduction catalysts.

FIGS. 2A-2F show relative motion and position of pistons and valves in an engine according to one embodiment of the disclosure at various stages of its operation. During operation, there is an intake stroke A (FIG. 2A) during which the piston in the compressor cylinder is traveling downwards in its cylinder bore while the compressor inlet valve is opened, its outlet valve being closed. This draws air into the compressor cylinder. The piston in the power cylinder is traveling upwards, its inlet valve being closed and its outlet valve being open. The inlet valve of the expander cylinder is open to the other power cylinder which is undergoing second expansion (E2), further explained below, its piston traveling downwards while its outlet valve is closed.

During the compression stroke C1 (FIG. 2B), the inlet valve of the compressor cylinder is closed and its outlet valve is open, allowing the gas present in the compressor cylinder to be forced into a power cylinder through the open inlet valve of the power cylinder, its outlet valve being closed. Owing to the larger volume of the compressor cylinder with respect to the power cylinder, this gas will be at a pressure that is higher than atmospheric, and the cylinders are dimensioned so that this is preferably any pressure in the range of between about 1.1 bar and about 8.0 bar. The piston in the power cylinder travels downward, admitting the gas from the compressor cylinder. The piston in the expander cylinder is traveling upwards, its inlet valve being closed and its outlet valve being open, to expel gas formerly present in the expander cylinder.

Figure 2A:
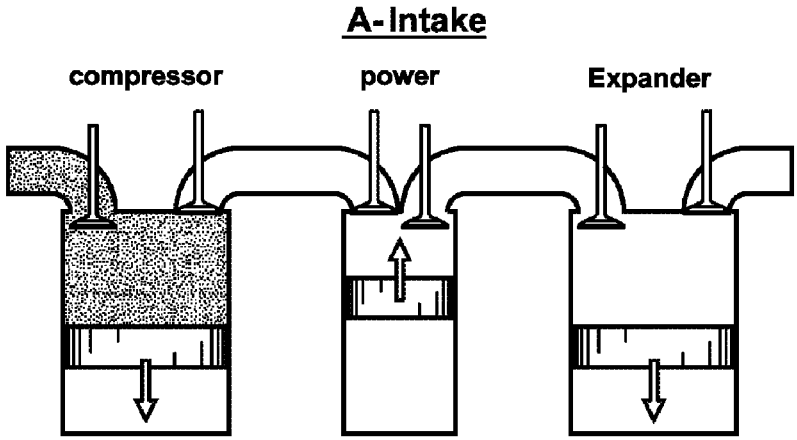
FIGS. 2A-2F show motion and position of pistons and valves in an engine according to one embodiment of the disclosure at various stages of its operation.
Figure 2B:
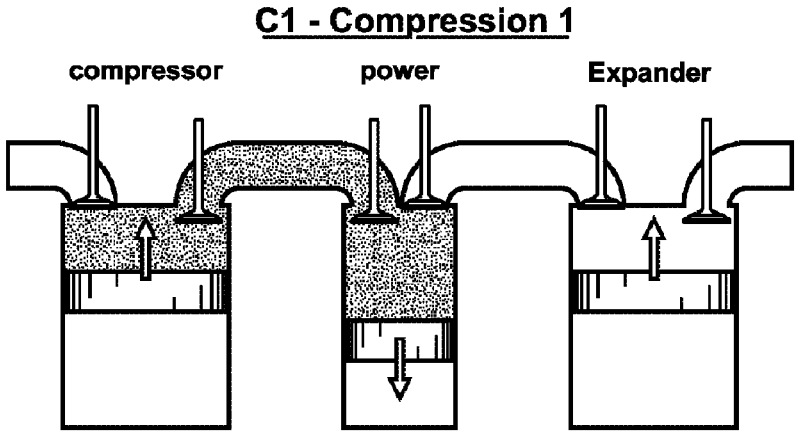
Figure 2C:
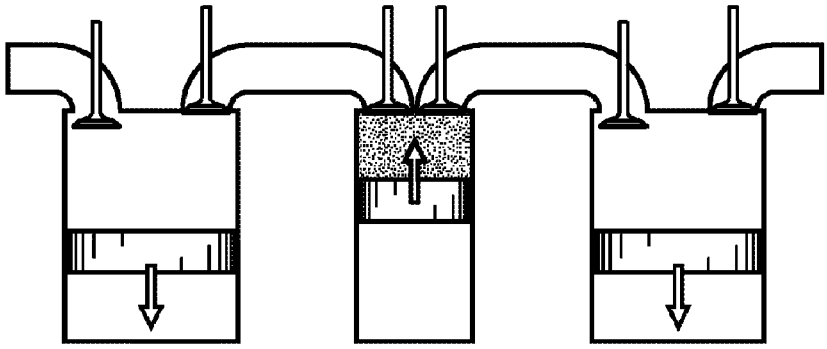
Figure 2D:
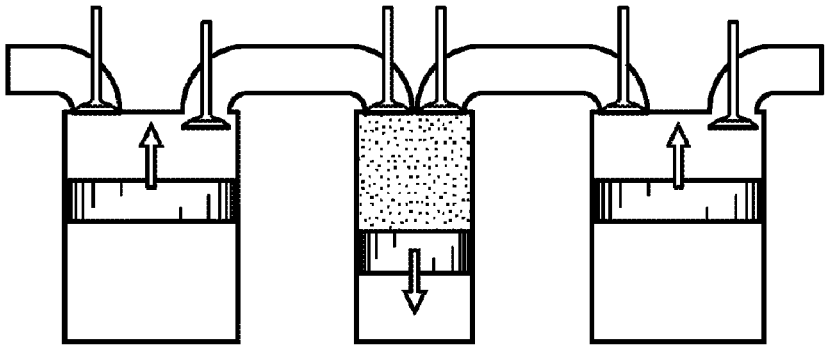
Figure 2E:
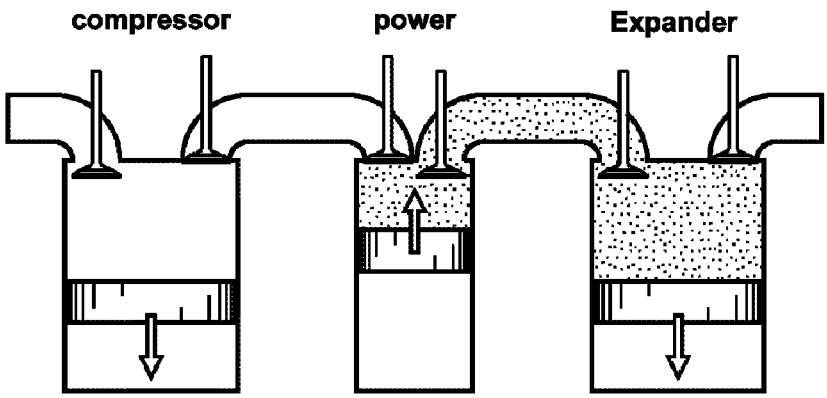

A second compression stroke C2 is shown in FIG. 2C, during which the inlet and outlet valves of the power cylinder are both closed, its piston traveling upwards in its bore to further compress its contained gases, prior to ignition, which may be a compression-ignition or a spark-ignition. During the upward travel of the piston in the power cylinder bore, the pistons in the compressor cylinder and expander cylinder are both traveling downwards in their bores, the inlet valves of these cylinders both being open and the outlet valves of these cylinders both being closed.

The compression stroke C2 is followed by an expansion stroke E1 (FIG. 2D) during which the gases produced as a result of the ignition and combustion in the power cylinder force the piston in the power cylinder downward, both valves in the power cylinder being closed during this power stroke. During the downward travel of the piston in the power cylinder bore, the pistons in the compressor cylinder and expander cylinder are both traveling upwards in their bores, the inlet valves of these cylinders both being closed and the outlet valves of these cylinders both being open.

Following the power stroke of the power cylinder, the piston present in the power cylinder travels upwards in its bore, expelling the substantially-combusted gases within it confines to the expander cylinder through its open outlet valve. During the upward travel of the piston in the power cylinder bore in this second expansion stroke E2 (FIG. 2E), the pistons in the compressor cylinder and expander cylinder are both traveling downwards in their bores, the inlet valves of these cylinders both being open and the outlet valves of these cylinders both being closed.

During the second expansion stroke E2, the outlet valve of the power cylinder is open and its inlet valve is closed, allowing the gas present in the power cylinder to be forced/expanded into the expander cylinder through the open inlet valve of the expander cylinder, its outlet valve being closed. In one embodiment, the expansion cylinder is dimensioned with respect to the power cylinder such that this gas will be expanded to a pressure that is about one bar pressure. In another embodiment, the expansion cylinder is dimensioned with respect to the power cylinder such that this gas will be expanded to a pressure that is above atmospheric pressure by any amount in the range of between about 0.05 bar and about 0.5 bar, including all ranges therebetween.

Figure 2F:
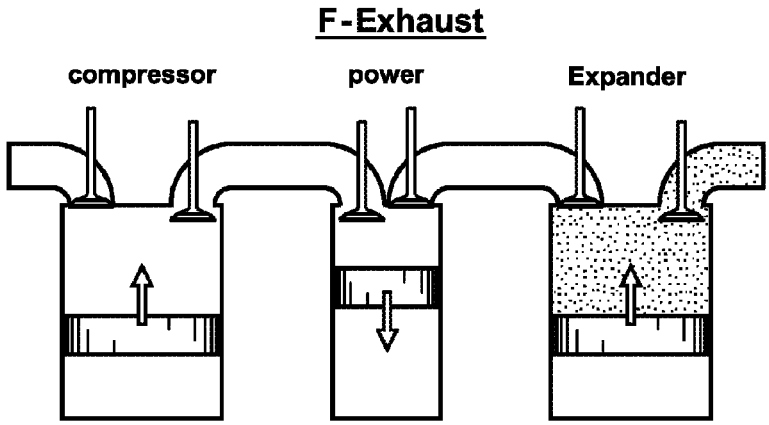

Finally, exhaust stroke F occurs as shown in FIG. 2F during which the pistons in the compressor cylinder and expander cylinder are both traveling upwards in their bores, the inlet valves of these cylinders both being closed and the outlet valves of these cylinders both being open, the open outlet valve of the expander cylinder enabling expulsion of the combusted, expanded gases from the engine. The piston in the power cylinder is traveling downwards, its inlet valve being open to admit a fresh charge of air for a subsequent combustion, the cycle outlined above (FIGS. 2A-2F) being repeated during operation of an engine as provided herein. For embodiments having a second power cylinder present, timing events of the engine are provided so that the output of the compressor cylinder feeds a first power cylinder from a first compression stroke of the compressor cylinder, and on its next subsequent compression stroke the compressor cylinder feeds its output to the second power cylinder. The timing events as outlined above having been provided in general terms, the valve opening and closing events, their net lift at the valve, duration and overlap are readily tailored to achieve degrees of gas reversion, air mass inertial management, etc., as may be desired for a given end-use application for an engine so described, using calculations and fabrication methods generally known in the art.

Thus, an engine as provided herein in one embodiment comprises an internal combustion engine in which the compression and expansion processes are performed in two stages, which occur in a combination of two separate cylinders. During the first stage of compression, the gas is compressed from a relatively larger compressor cylinder into a relatively smaller power cylinder, with a power cylinder undergoing a conventional 4-stroke cycle. The second expansion stage occurs between a power cylinder and a larger expander cylinder, which expansion enables increased thermodynamic efficiency by recovery of chemical energy and of heat that is otherwise lost when not operating according to this disclosure. Moreover, the presence of an expander cylinder as used herein affords an increased number of operating variables, advantage of which can be taken towards reducing engine emissions through temperature control during compression.

Figure 3:
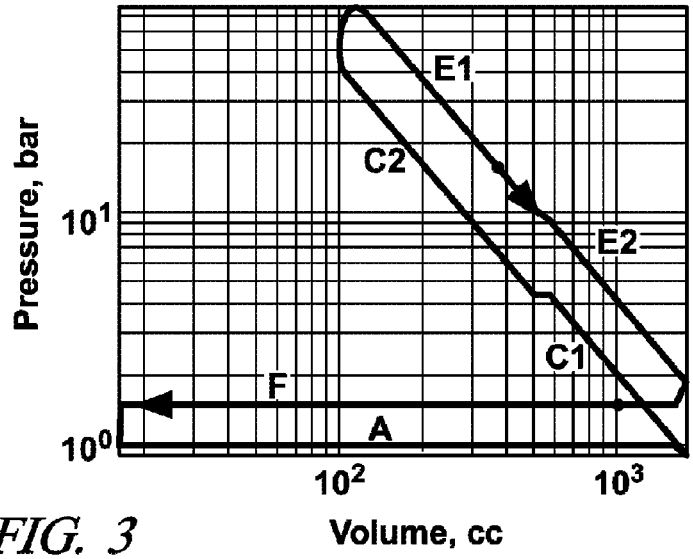
FIG. 3 illustrates a pressure to volume relationship over a cycle for the working fluid in an operating engine according to one embodiment of the disclosure.

In FIG. 3 is illustrated a pressure to volume relationship over a cycle for the working fluid in an operating engine according to one embodiment of the disclosure, particularly in reference to the cycle shown and described in reference to FIG. 2. At each stage of the graph are labeled those portions that correspond with the strokes (A, C1, C2, E1, E2 and F) previously described. Thus, an engine according to this embodiment is a six-stroke engine of 1080 crank angle degrees (CAD) per cycle, but having a 360 CAD overlap between cycles relative to each pair of power cylinders corresponding to each compressor and expander cylinder pair.

Figure 4:
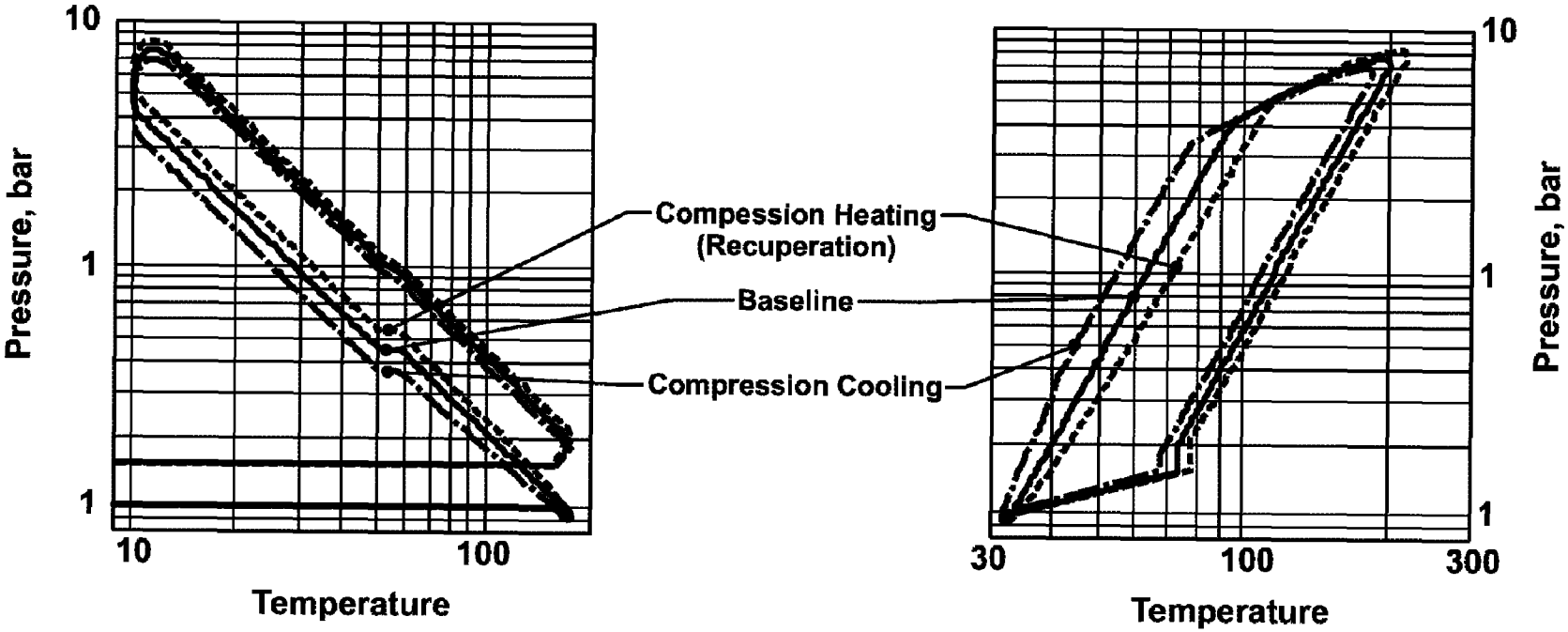
FIG. 4 illustrates comparisons of a pressure to volume relationship and a pressure to temperature relationship over a cycle for a power cylinder in an operating engine according to one embodiment of the disclosure.

One benefit of an engine as described is that it is possible to recuperate heat from the expander cylinder by means of a heat exchanger, and utilize this heat by transferring it to the intake gas of the power cylinder in a heat recuperation process. In conventional combustion engines, this thermal energy is essentially wasted, being incapable of doing any pressure*volume work. By recuperating the otherwise-wasted heat to the gas inducted for combustion, the thermodynamic efficiency of an engine according to the disclosure is higher than engines not incorporating this feature. This is illustrated more clearly in FIG. 4, which illustrates comparisons of a pressure to volume relationship and a pressure to temperature relationship over a cycle for the working fluid in an operating engine so described. From these graphs it is evident that the effective area inside the P-V curve which represents useful work, is greater for the cycle with recuperation as herein described. A further benefit is achieved by increasing the isothermal character of the compression occurring in the compressor cylinder by injecting a liquid substance, including without limitation water, into the compressor cylinder during engine operation.

Figure 5:
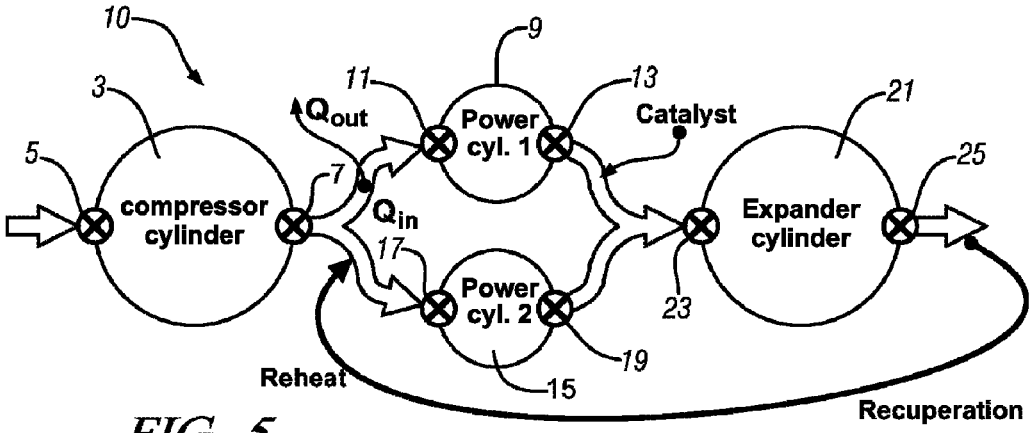
FIG. 5 provides a schematic representation of heat flows present in an engine according to one embodiment of the disclosure.

In an alternative operating mode, the heat exchanger mentioned above is used to cool the gases comprising the intake charge for the power cylinder(s). Such compression cooling, when employed, is beneficial towards reducing any present tendencies towards pre-ignition in spark-ignition engines or spark-assisted compression engines. FIG. 5 provides a schematic representation of heat flows present in an engine according to one embodiment of the disclosure incorporating the features described and further showing a catalyst present between the outlet of a power cylinder and the inlet of the expander cylinder. For cases where the gases exiting the power cylinder following ignition/combustion contain unburned fuel, the presence of a catalyst at this stage provides for generation of additional heat via more complete combustion, which is typically otherwise lost in an oxidation catalyst stage as part of an effluent gas aftertreatment system. Recovery of chemical energy from catalytic oxidation at this stage enhances the efficiency of the engine. The catalyst may be any conventional heterogeneous catalyst disposed in a conventional manner, such as on a bed or monolith and may itself be assisted by injection of gases or liquids such as compressed air.

While the foregoing description has been provided in reference to an engine comprising four cylinders, it can now be appreciated by one of ordinary skill in the art after having considered this specification that the disclosure inherently and readily provides additional engines according to its teachings which are configured to exist in eight-cylinder configuration, a twelve-cylinder configurations or substantially any configurations comprising an integral multiple of the four cylinders described (i.e. groupings of one compressor cylinder, two power cylinders and i=one expander cylinder), by use of conventional casting and machining techniques generally known and employed in the engine block and component manufacturing arts.

By controlling the relative ratios of the swept volumes of the pistons in their travel within the bores of cylinders in which they are disposed, i.e., the cylinder's effective displacements, it is readily possible when providing an engine in accordance with this disclosure to provide a wide range of possible compression ratios of the power cylinder, thus controlling volumetric and thermodynamic efficiency. A compressor cylinder of an engine according to some embodiments of the disclosure is dimensioned relative to a power cylinder so that the ratio of the displacement of a compressor cylinder to that of a power cylinder is any ratio in the range of between about 5:1 to about 1.1:1, including all ratios and ranges of ratios therebetween. The expander cylinder is dimensioned with respect to the power cylinder in an engine according to some embodiments of the disclosure so that the ratio of the displacement of the expander cylinder to that of the power cylinder is any ratio in the range of between about 5:1 to about 1.1:1, including all ratios and ranges of ratios therebetween. In some embodiments, the displacements of the expander and compressor cylinders are substantially equal. In one alternate embodiment, the displacement of the compressor cylinder is greater than that of the expander cylinder. In another embodiment, the displacement of the compressor cylinder is less than that of the expander cylinder. In some embodiments, the ratio of displacement of the expander cylinder to that of the compressor cylinder is any ratio in the range of between about 5:1 to about 1:5, including all ratios and ranges of ratios therebetween. Owing to the wide variability in displacement volumes of the cylinders present, a wide range of compression ratios may be provided, giving higher pressure ratios capabilities and higher thermodynamic efficiencies than turbo-charger or super-charger equipped engines. This is augmented in part at least by the provision that during operation of an engine according to the disclosure, the transfer of the gas from one cylinder to another during the compression process introduces the ability to transfer heat to or from the charge gas during the closed portion of the compression process.

An engine as provided herein may be operated using any combustible fuel, which include without limitation the conventional fuels: hydrogen, aliphatic hydrocarbons, aromatic hydrocarbons, oils, waxes, diesel fuels, gasolines, and oxygenated fuels including alcohols, ethers and esters, and including mixtures of the foregoing. In alternate embodiments an engine according to the disclosure may also be operated using non-conventional fuels, which include without limitation powdered coal, waste oils and bio-mass derivatives.

In preferred embodiments the combustible fuel is provided to the combustion chamber of the power cylinder. In alternate embodiments, the combustible fuel is provided to a location adjacent to the inlet valve of the power cylinder that ensures its admission into the power cylinder during operation.

In other alternate embodiments, a combustible fuel is provided to the expander cylinder or a location adjacent its inlet valve that ensures its admission into the expander cylinder during operation. Embodiments where a combustible fuel is fed to the expander cylinder can be advantageously used as an after-burner to reduce emissions and gain efficiency increases.

In further alternate embodiments, the combustible fuel is provided to the compressor cylinder. In alternate embodiments, the combustible fuel is provided to a location adjacent to the inlet valve of the compressor cylinder that ensures its admission into the compressor cylinder during operation.

In some alternate embodiments an aftertreatment solution is caused to be admitted to the expander cylinder, including without limitation solutions of urea and other known reductants useful for lowering particulant emissions and/or nitrogen oxide emissions from the engine. Known reductants include solutions of organic nitrogen compounds and inorganic nitrogen compounds. Such advantageous use of reductants lessen the burden presented to emissions-treatment systems or devices located downstream of the expander cylinder, for motorized vehicles or other manufactures desirously possessed of emissions-treating equipment.

Further increases in efficiency of an engine according to any embodiments provided may be effected by providing a layer of a thermally-insulating material on any portion of an engine according to the disclosure, for example the gas transfer port disposed between a power cylinder and an expander cylinder, the gas transfer port disposed between a power cylinder and a compressor cylinder, the expander cylinder itself, and the power cylinder itself. In one embodiment the insulation is any suitable ceramic material, which may be provided in the form of a coating to the interior surfaces or exterior surfaces of the ports, cylinders, pistons, or any other portion of an engine as provided herein. However, any other suitable thermally-insulating material known in the art may be employed.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. An internal combustion engine comprising:

a compressor cylinder having a bore, a valved inlet port, and a valved outlet port, said bore having a first piston slidably disposed therein, the first piston being operatively connected to a crankshaft;

at least one power cylinder having a bore, a valved inlet port, and a valved outlet port, said bore having a second piston slidably disposed therein, the second piston being operatively connected to the crankshaft;

an expander cylinder having a bore, a valved inlet port, and a valved outlet port, said bore having a third piston slidably disposed therein, the third piston being operatively connected to the crankshaft;

said engine further comprising a camshaft operatively connected to said crankshaft sufficient to cause the valves present on said inlet ports and said outlet ports of said compressor cylinder and said expander cylinder to each undergo one open-closed cycle for every revolution of said crankshaft, and to cause said valves present on said inlet port and said outlet port of said at least one power cylinder to each undergo one open-closed cycle for every two revolutions of said crankshaft;

said compressor cylinder draws gas through the intake port of said compressor cylinder and forces said gas through the outlet port of said compressor cylinder into said at least one power cylinder through the inlet port of said at least one power cylinder;

said at least one power cylinder comprising four-stroke operation having only one power stroke and only one exhaust stroke every two revolutions of the crankshaft compresses said gas within the at least one power cylinder prior to ignition of said gas and forces exhaust gas resulting from said ignition through the outlet port of said at least one power cylinder into said expander cylinder through the inlet port of said expander cylinder; and said expander cylinder expands said exhaust gas within the expander cylinder and expels said exhaust gas through the outlet port of said expander cylinder.

2. An engine according to claim 1 wherein the displacement volume of the compressor cylinder exceeds that of said at least one power cylinder sufficiently to enable gas expelled from said compressor cylinder into said at least one power cylinder to be at a greater pressure upon entering said at least one power cylinder than the pressure that the same gas was at upon its entry into said compressor cylinder.

3. An engine according to claim 2 configured sufficiently to enable at least some compression of the gas admitted to the power cylinder to occur in a passage between the outlet port of the compressor cylinder and the inlet port of the power cylinder.

4. An engine according to claim 1 wherein the displacement volume of the expander cylinder exceeds that of the power cylinder sufficiently to enable gas expelled from said power cylinder into said expander cylinder to be at a lower pressure when present in said expander cylinder than the pressure that the same gas was at upon its exit from said power cylinder.

5. An engine according to claim 4 configured sufficiently to enable at least some expansion of the gas admitted to the expander cylinder to occur in a passage between the outlet port of the power cylinder and the inlet port of the expander cylinder.

6. An engine according to claim 1 wherein the ratio of the displacement of the compressor cylinder to that of the power cylinder is any ratio in the range of between 5:1 to 1.1:1, including all ratios and ranges of ratios therebetween.

7. An engine according to claim 1 wherein the ratio of the displacement of the expander cylinder to that of the power cylinder is any ratio in the range of between 5:1 to 1.1:1, including all ratios and ranges of ratios therebetween.

8. An engine according to claim 1 further comprising a heat exchanger in effective thermal contact with gases exiting the expander cylinder, and with gases present in a passage between the outlet port of the compressor cylinder and the inlet port of the power cylinder.

9. An engine according to claim 8 wherein heat is transferred from said gases exiting said expander cylinder to gases admitted to said power cylinder.

10. An engine according to claim 1 further comprising a heat exchanger in effective thermal contact with gases present in the passage between the outlet port of the compressor cylinder and the inlet port of the power cylinder, wherein said heat exchanger effectively removes heat from said gases present.

11. An engine according to claim 1 further comprising an oxidation catalyst present in the passage between the outlet valve of said power cylinder and the inlet valve of said expander cylinder.

12. An engine according to claim 1 whose combustion and valve timing events are configured to enable compression and expansion processes to occur between two separate cylinders.

13. An engine according to claim 1 comprising groupings of one compressor cylinder, two power cylinders and one expander cylinder.

14. An internal combustion engine comprising a power cylinder, a compressor cylinder and an expander cylinder, wherein said compressor cylinder provides a compressed air charge for said power cylinder comprising four-stroke operation having only one power stroke and only one exhaust stroke every two revolutions of a crankshaft and wherein said power cylinder further compresses the compressed air charge prior to combustion of said air charge and forces combustion gases resulting from said combustion to said expander cylinder and wherein said expander cylinder expands said combustion gases within the expander cylinder and expels said combustion gases, each of said cylinders being equipped with a reciprocating assembly comprising pistons and the crankshaft, with the pistons of each cylinder each being operatively connected to the common crankshaft.

15. An engine according to claim 14 further comprising an oxidation catalyst in effective contact with a gas caused to exit said power cylinder during operation of said engine.

16. An engine according to claim 14 wherein at least one component of said engine is provided with a layer of a thermally-insulating material.

17. A process for operating an internal combustion engine comprising:

providing a piston-driven internal combustion engine having a compression cylinder, at least one power cylinder, and an expander cylinder, each of said cylinders having a valved inlet and a valved outlet, the outlet of the compression cylinder being in effective fluid communication with the inlet of the power cylinder, and the outlet of the power cylinder being in effective fluid communication with the inlet of the expander cylinder, said engine being configured so that the pistons present in each of said cylinders are driven by a common crankshaft, and further configured so that the valves present at the inlet and outlet of said compressor cylinder and said expander cylinder each undergo one open-closed cycle for every revolution of the crankshaft, and the valves present at the inlet and said outlet of said power cylinder each undergo one open-closed cycle for every two revolutions of said crankshaft, wherein said power cylinder comprises four-stroke operation having only one power stroke and only one exhaust stroke every two revolutions of the crankshaft;

drawing a gas through an inlet of the compression cylinder and forcing said gas through the outlet of said compression cylinder into said inlet of said at least one power cylinder;

providing a combustible fuel to said engine;

compressing said gas within said at least one power cylinder prior to ignition of said gas;

providing an ignition source to said at least one power cylinder;

forcing exhaust gas resulting from said ignition through the outlet of said at least one power cylinder into said expander cylinder through the inlet of said expander cylinder; and expanding said exhaust gas within said expander cylinder.

18. A process according to claim 17 wherein said engine is configured to enable compression and expansion processes to occur between two separate cylinders.

19. A process according to claim 17 further comprising:

providing a heat exchanger which causes heat to flow from the gases present in the outlet of said expander cylinder, to the gases that are caused to enter the power cylinder.

20. A process according to claim 17 further comprising:

providing a heat exchanger which causes heat to flow out of the gases that are caused to enter the power cylinder.

21. A process according to claim 17, further comprising:

providing an oxidation catalyst to contact gases exiting said power cylinder prior to their entry into said expander cylinder.

22. A process according to claim 17 wherein said combustible fuel is provided to said engine at a location selected from the group consisting of said compressor cylinder, said power cylinder, said expander cylinder, and any location sufficient to enable said fuel to enter at least one of said cylinders during engine operation.

23. A process according to claim 17 further comprising:

causing a nitrogen compound to be admitted to said expander cylinder during engine operation.

* * * * *